United States Patent [19]

O'Neal

[11] Patent Number: 4,521,128

[45] Date of Patent: Jun. 4, 1985

[54] DISPOSABLE TOOTHBRUSH WITH CAP

[76] Inventor: Chester L. O'Neal, 809 Gardenside Dr., Greencastle, Ind. 46135

[21] Appl. No.: 564,034

[22] Filed: Dec. 21, 1983

Related U.S. Application Data

[63] Continuation of Ser. No. 370,454, Apr. 21, 1982, abandoned.

[51] Int. Cl.[3] ..... A46B 11/02

[52] U.S. Cl. ..... 401/183; 401/184; 401/269; 401/286

[58] Field of Search ..... 401/269, 286, 183, 184, 401/288

[56] References Cited

U.S. PATENT DOCUMENTS

| | | | |
|---|---|---|---|
| 570,573 | 11/1896 | Tower | 401/269 |
| 919,440 | 4/1909 | Lawson et al. | 401/269 X |
| 1,049,863 | 1/1913 | Happle et al. | 401/269 X |
| 1,563,190 | 11/1925 | House | 401/286 |
| 2,259,928 | 10/1941 | Eaton | 401/184 |
| 3,936,200 | 2/1976 | O'Rourke | 401/184 |
| 4,221,492 | 9/1980 | Boscardin et al. | 401/288 X |

FOREIGN PATENT DOCUMENTS

| | | | |
|---|---|---|---|
| 1904801 | 8/1970 | Fed. Rep. of Germany | 401/183 |
| 252110 | 12/1947 | Switzerland | 401/183 |

*Primary Examiner*—Steven A. Bratlie

*Attorney, Agent, or Firm*—Woodard, Weikart, Emhardt & Naughton

[57] ABSTRACT

A disposable toothbrush containing dentifrice with enclosure cap. The toothbrush main body has a hollow squeezable handle with dentifrice therein. A passage leads from the handle to an outlet on the brush head with the dentifrice flowing outwardly from the head between the opposite ends of the bristles. A cap removably mounted to the brush head encloses the bristles and has a plug sealingly projectable into the dentifrice outlet.

1 Claim, 4 Drawing Figures

DISPOSABLE TOOTHBRUSH WITH CAP

This application is a continuation of application Ser. No. 370,454 filed Apr. 21, 1982, now abandoned.

BACKGROUND OF THE INVENTION

This invention is in the field of disposable brushes including toothbrushes. In my U.S. Pat. No. 4,176,980, there is disclosed a disposable toothbrush having a squeezable hollow handle with dentifrice therein forceable outwardly through outlets located between the bristles. An adaptation of my aforementioned brush is disclosed herein in that the squeezable hollow handle is provided in the design. In contrast to my prior design, my new brush includes only a single dentifrice outlet with a raised ring surrounding the outlet to position the dentifrice away from the mounting plane of the bristles to the brush head but also positioning the dentifrice remotely from the distal ends of the bristles. The positioning of the dentifrice is distinguishable from the tubular outlets in the toothbrush disclosed in the Australian patent specification No. 254459 issued to Norman John Hobson wherein the dentifrice is located only at the outer end portions of the bristles. Another improvement in the brush disclosed herein is the addition of a cap removably mounted to the brush and enclosing the bristles to allow repeated sanitary use of the brush in the event dentifrice remains within the handle. It is known to use a bristle enclosure such as disclosed in U.S. Pat. No. 3,653,778, issued to John Robert Freilling; however, the cap disclosed herein includes a plug extending outwardly to removably seal and engage the dentifrice outlet on the brush head precluding accidental discharge of the dentifrice from the brush.

SUMMARY OF THE INVENTION

One embodiment of the present invention is a disposable brush comprising a main body including a hollow squeezable handle forming a container holding material to be dispensed, a shank connected to the handle and a head connected to the shank, the main body including a passage leading from the container through the shank to the head and further including an outlet on the head opening into the passage, bristles mounted on and extending outwardly from the head at the outlet, and a cap removably mounted to the head and enclosing the bristles, the cap including a plug mounted thereto removably extending sealingly into the outlet limiting flow of the material from the outlet when the cap is mounted on the head.

It is an object of the present invention to provide a new and improved disposable toothbrush and dentifrice combination.

Another object of the present invention is to provide a disposable toothbrush having a hollow, squeezable, dentifrice containing, handle sufficiently rigid to allow use once the dentifrice is discharged.

A further object of the present invention is to provide a disposable, dentifrice containing, toothbrush having a dentifrice outlet located away from the mounting plane of the bristles and remotely from the bristle distal ends.

Yet another object of the present invention is to provide a disposable brush having a dentifrice outlet with a cap enclosing the bristles and plugging the dentifrice outlet.

Related objects and advantages of the present invention will be apparent from the following description.

DESCRIPTION OF THE PREFERRED EMBODIMENT

Figure 1:
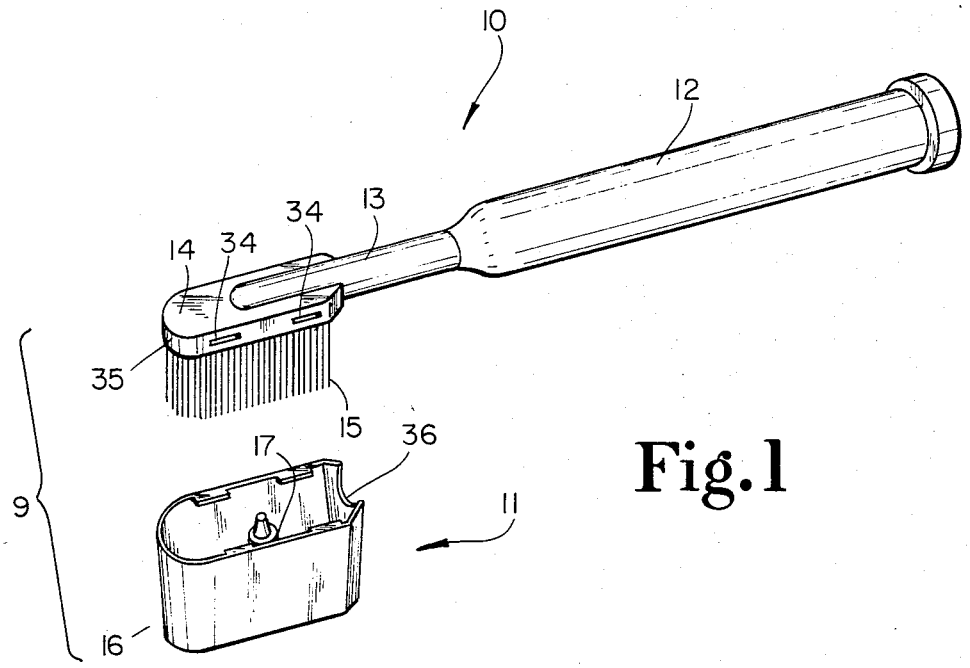
FIG. 1 is an exploded view of the toothbrush and cap incorporating the present invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
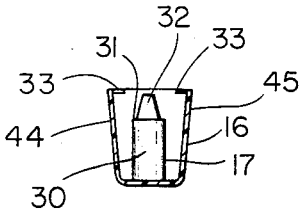
FIG. 4 is a cross-sectional view of the cap of FIG. 1.
Figure 1:
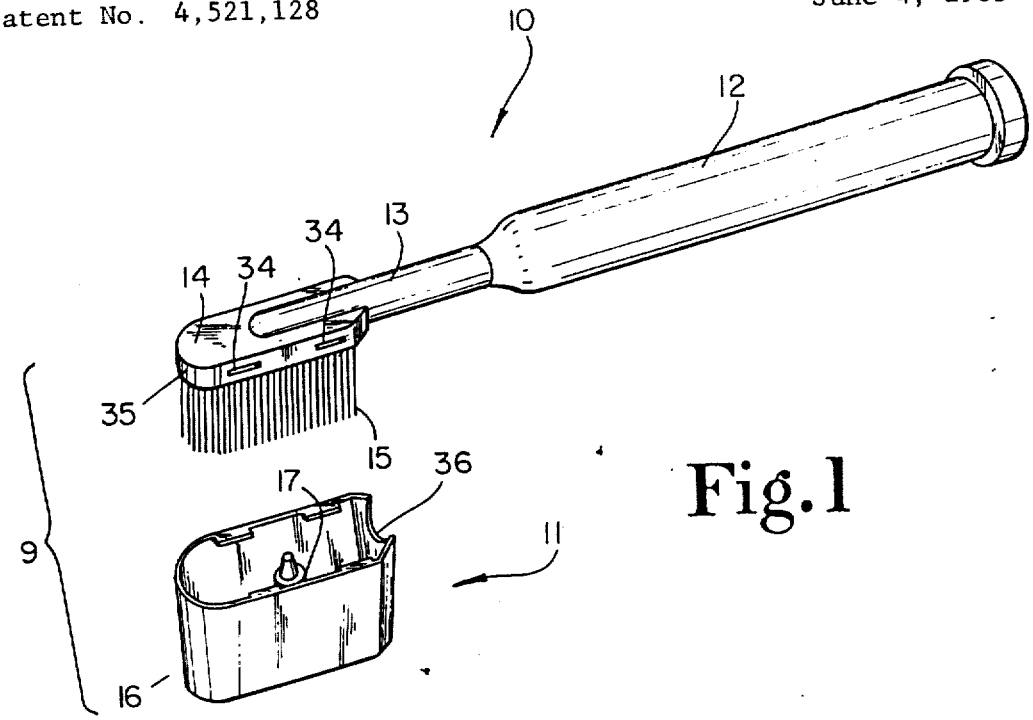
Figure 2:
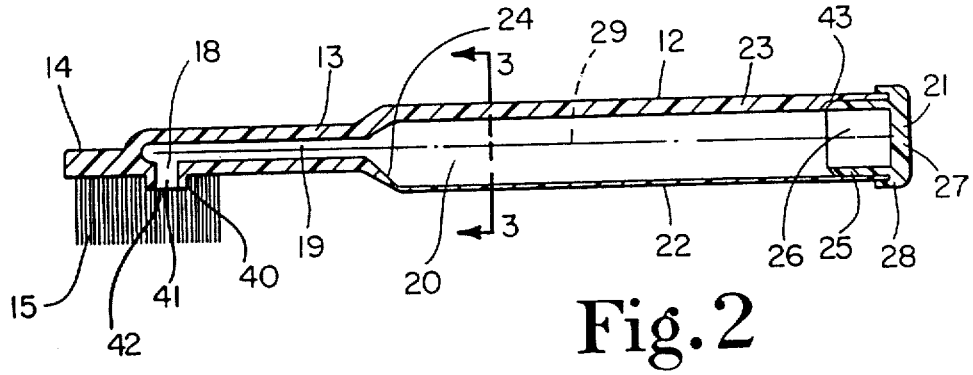
Figure 3:
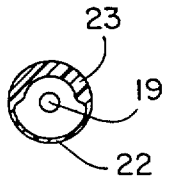
Figure 4:
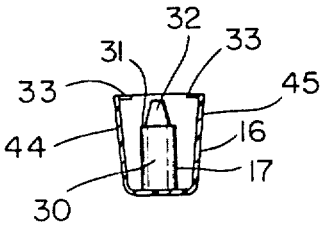

Referring now more particularly to FIG. 1, there is shown a brush cap combination 9 with the particular combination shown being a toothbrush 10 with a cap 11 to removably mount to the brush and enclose bristles 15 cantileveredly mounted to the head 14 of the brush. Head 14 is attached to handle 12 by means of a shank 13 and may be produced in one integral plastic piece. Cap 16 may also be produced from plastic and includes a pair of diverging side walls 44 and 45 (FIG. 4) to guide bristles 15 into the cap as the cap is mounted onto head 14. A plurality of inwardly projecting tabs 33 are mounted to the free edge portion of the cap side walls with the tabs lockingly projectable into slots 34 (FIG. 1) formed on the edge portion 35 of head 14 thereby securing the cap on the head. The end side wall of the main body 16 of cap 11 includes a radially cut away portion 36 complementarily receiving the circular shank 13 and limiting movement of the cap on the main body of the brush.

Handle 12 is hollow and squeezable forming a container 20 holding the particular material to be dispensed through bristles 15. Passage 19 is in fluid communication with container 20 extending through shank 13 to outlet 18 provided on head 14. Bristles 15 are mounted to head 14 and surround outlet 18. A circular ring 40 is mounted to head 14 and has an aperture 41 aligned with outlet 18 to position the dentifrice or other material provided within container 20 at a location apart from the mounting location of bristles 15 to head 14 but yet sufficiently remote from the distal ends of the bristles. Thus, the dentifrice will not build up on the mounting plane of the bristles to the head but yet will be sufficiently remote from the distal ends of the bristles allowing the dentifrice to flow uniformly through the remaining length of the bristles.

Figure 3:
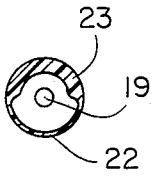
FIG. 3 is a reduced cross-sectional view taken along the line 3—3 of FIG. 2 and viewed in the direction of the arrows.

The construction of handle 12 is shown in FIG. 3. The handle includes a semi-circular thick side wall 23 integrally joined to a semi-circular thin side wall 22 with the side walls extending the length of the handle. Thin side wall 22 is of flexible material to allow the wall to be squeezed and moved toward thick wall 23 forcing the dentifrice out through passage 19 and aperture 41. Side wall 23 is sufficiently rigid to prevent the handle from being bowed as the thin wall is squeezed.

Figure 2:
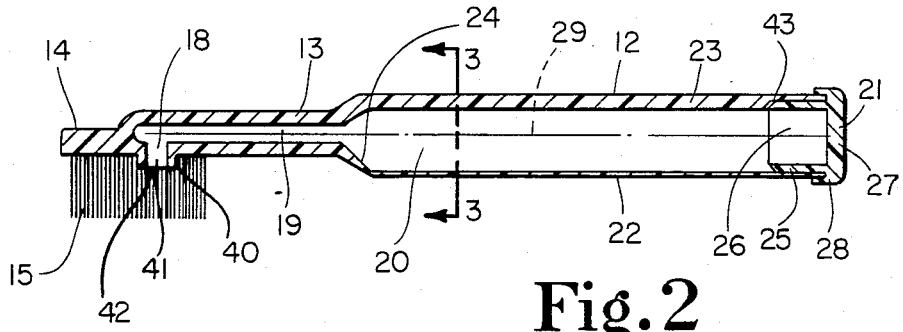
FIG. 2 is an enlarged longitudinal cross-sectional view of the brush of FIG. 1.

A closure 21 is sealingly mounted to the end of handle 12 once the dentifrice is loaded into the handle. Closure 21 has a tubular main body 25 with an inner end 26 opening into the handle allowing the dentifrice to flow into closure 21 maximizing the amount of dentifrice or other material contained within the handle. The opposite end 27 of closure 21 is closed preventing the dentifrice from escaping the brush except through aperture 41. Closure 21 includes a peripherally extending edge portion 28 forming a circular slot to slidably and sealingly receive the end of handle 12. Closure 21 may be joined to handle 12 by a variety of means including heat sealing. Tubular main body 25 fits within a radial relief provided in side wall 23 (FIG. 2) which conformingly receives tubular body 25. End 27 of the closure is of a rigid material further strengthening the handle of the brush.

The toothbrush has a longitudinal axis 29 extending centrally through closure 21 and centrally through passage 19. Further, axis 29 is located a fixed radial distance (FIG. 3) from thick side wall 23 and a fixed radial distance from thin side wall 22 when the thin side wall is not compressed or moved towards the thick side wall. Side wall 23 extends one-half way around axis 29 to provide a grasping portion while brushing without depressing or moving wall 22 towards wall 23. Passage 19 is flared outwardly via surface 24 into container 20 to guide the dentifrice from the container and into the passage to outlet 41.

Cap 11 has a plug 17 (FIG. 4) integrally mounted thereto with an outer tapered distal end 32 provided on the plug to removably extend into aperture 41 of the toothbrush head. A stop surface 31 is provided adjacent distal end 32 to contact against the outwardly facing surface 42 of ring 40. Plug 17 has a cylindrical main body 30 integrally attached to the tapered distal end 32 with stop surface 31 being located between end 32 and main body 30. Surface 31 along with distal end 32 cooperatively seal inlet 41 when cap 11 is mounted to head 14 limiting flow of the dentifrice from the outlet.

Many variations of the present invention are contemplated and included herein. While although the drawings depict a toothbrush and dentifrice combination, it is to be understood that similar materials may be provided within a brush as disclosed for polishing or scrubbing a variety of items. While the toothbrush is disclosed as including ring 40 surrounding outlet 18, it is to be understood that a toothbrush may be produced without the ring merely allowing the dentifrice to exit outlet 18 immediately adjacent the mounting plane of bristles 15.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A disposable toothbrush device comprising:

A. a unitary toothbrush member comprising:

a squeezable tubular handle with a dispensing end and a filler end and forming a container extending therebetween adapted to hold dentifrice to be dispensed, the tubular handle having a rigid thick portion of the circumference integrally connected to a flexible thin portion of the circumference, both portions extending from the dispensing end to a location immediately adjacent the filler end whereby the thin portion of the circumference of the handle can be pressed against the rigid portion to force dentifrice out of the dispensing end;

a shank connecting the dispensing end of the handle to a brush head;

a brush head connected to the shank with bristles extending outwardly therefrom; and a passage leading from the handle through the shank to the head and opening between the bristles to deliver dentifrice adjacent the base of the bristles remotely from the distal ends of the bristles when the handle is squeezed;

B. a cap member removably mounted to the head and enclosing the bristles, the cap including an extending plug mounted thereto removably extending sealingly into the opening limiting flow of dentifrice from the opening when the cap is mounted on the head, said plug being generally cylindrical and terminating at the distal end by a truncated cone of smaller diameter than the main body of the plug thereby defining a shoulder adjacent the distal end and contactable against the head, the shoulder and the distal end cooperatively sealing the passage when the cap is mounted to the head; the cap including a free edge portion with inwardly projecting tabs on the two long edges thereof lockingly engaging cooperation securing means on the edge portion of said head, removably securing the cap on the head, the free edge portion of the cap having a cut away portion receiving the shank and limiting movement thereon; and C. a closure member adapted to close the said filler end of said tubular handle.

* * * * *

UNITED STATES PATENT AND TRADEMARK OFFICE

CERTIFICATE OF CORRECTION

PATENT NO. : 4,521,128

DATED : June 4, 1985

INVENTOR(S) : Chester L. O'Neal

It is certified that error appears in the above-identified patent and that said Letters Patent is hereby corrected as shown below:

In the single sheet of drawings delete Figures 1 - 5 to be replaced with the sheet of drawings consisting of Figures 1 - 4, as shown on the attached sheet.

Signed and Sealed this

*Tenth* Day of *December 1985*

[SEAL]

*Attest:*

DONALD J. QUIGG

*Attesting Officer* *Commissioner of Patents and Trademarks*